US010752979B2

(12) United States Patent
Kondo et al.

(10) Patent No.: US 10,752,979 B2
(45) Date of Patent: Aug. 25, 2020

(54) LOW ALLOY OIL-WELL STEEL PIPE

(71) Applicant: NIPPON STEEL & SUMITOMO METAL CORPORATION, Tokyo (JP)

(72) Inventors: Keiichi Kondo, Izumisano (JP); Yuji Arai, Amagasaki (JP)

(73) Assignee: NIPPON STEEL CORPORATION, Tokyo (JP)

( * ) Notice: Subject to any disclaimer, the term of this patent is extended or adjusted under 35 U.S.C. 154(b) by 335 days.

(21) Appl. No.: 15/518,024

(22) PCT Filed: Oct. 2, 2015

(86) PCT No.: PCT/JP2015/005027

§ 371 (c)(1),
(2) Date: Apr. 10, 2017

(87) PCT Pub. No.: WO2016/059763

PCT Pub. Date: Apr. 21, 2016

(65) Prior Publication Data

US 2017/0306461 A1 Oct. 26, 2017

(30) Foreign Application Priority Data

Oct. 17, 2014 (JP) ..... 2014-213094

(51) Int. Cl.
*C22C 38/22* (2006.01)
*C21D 9/08* (2006.01)
(Continued)

(52) U.S. Cl.
CPC ..... *C22C 38/22* (2013.01); *C21D 9/08* (2013.01); *C22C 38/00* (2013.01); *C22C 38/001* (2013.01);
(Continued)

(58) Field of Classification Search
None
See application file for complete search history.

(56) References Cited

U.S. PATENT DOCUMENTS 5,938,865 A * 8/1999 Kondo ..... C21D 8/10 148/593
8,696,834 B2 * 4/2014 Kondo ..... C21D 8/105 148/593
(Continued)

FOREIGN PATENT DOCUMENTS

CA 2 843 593 2/2013
CA 2 849 287 9/2013
(Continued)

OTHER PUBLICATIONS

Tsuchiyama, Toshihiro, "Physical Meaning of . . . Heat Treatment Process", Journal of the Japan Society for Heat Treatment, vol. 42, No. 3, p. 165 (2002), and its English translation.

*Primary Examiner* — Alexandra M Moore
*Assistant Examiner* — Adil A. Siddiqui
(74) *Attorney, Agent, or Firm* — Clark & Brody LP

(57) ABSTRACT

Provided is a low alloy oil-well steel pipe having a yield strength of 793 MPa or more, and an excellent SSC resistance. A low alloy oil-well steel pipe according to the present invention includes a chemical composition consisting of: in mass %, C: 0.25 to 0.35%; Si: 0.05 to 0.50%; Mn: 0.10 to 1.50%; Cr: 0.40 to 1.50%; Mo: 0.40 to 2.00%; V: 0.05 to 0.25%; Nb: 0.010 to 0.040%; Ti: 0.002 to 0.050%; sol. Al: 0.005 to 0.10%; N: 0.007% or less; B: 0.0001 to 0.0035%; and Ca: 0 to 0.005%; and a balance being Fe and impurities. In a microstructure of the low alloy oil-well steel pipe, a number of cementite particles each of which has an equivalent circle diameter of 200 nm or more is 100 particles/100
(Continued)

$\mu m^2$ or more. The above low alloy oil-well steel pipe has a yield strength of 793 MPa or more.

2 Claims, 1 Drawing Sheet

(51) Int. Cl.

| | |
|---|---|
| ***C22C 38/32*** | (2006.01) |
| ***C22C 38/00*** | (2006.01) |
| ***C22C 38/50*** | (2006.01) |
| ***C22C 38/48*** | (2006.01) |
| ***C22C 38/44*** | (2006.01) |
| ***C22C 38/54*** | (2006.01) |
| ***C22C 38/46*** | (2006.01) |
| ***C22C 38/02*** | (2006.01) |
| ***C22C 38/04*** | (2006.01) |
| ***C22C 38/06*** | (2006.01) |
| ***C22C 38/24*** | (2006.01) |
| ***C22C 38/26*** | (2006.01) |
| ***C22C 38/28*** | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/24* (2013.01); *C22C 38/26* (2013.01); *C22C 38/28* (2013.01); *C22C 38/32* (2013.01); *C22C 38/44* (2013.01); *C22C 38/46* (2013.01); *C22C 38/48* (2013.01); *C22C 38/50* (2013.01); *C22C 38/54* (2013.01)

(56) References Cited

U.S. PATENT DOCUMENTS

| | | | | |
|---|---|---|---|---|
| 10,233,520 | B2 * | 3/2019 | Soma | C22C 38/04 |
| 2006/0016520 | A1 | 1/2006 | Numata et al. | |
| 2015/0041030 | A1 * | 2/2015 | Kondo | C21D 8/10 148/663 |

FOREIGN PATENT DOCUMENTS

| | | | | |
|---|---|---|---|---|
| CA | 2 937 139 | | 12/2015 | |
| CN | 101146924 | | 3/2008 | |
| EP | 1 728 877 | | 12/2006 | |
| EP | 2415884 | | 2/2012 | |
| EP | 2 447 386 | | 5/2012 | |
| EP | 2 749 664 | | 7/2014 | |
| JP | 59-232220 | | 12/1984 | |
| JP | 62-253720 | | 11/1987 | |
| JP | 06-322478 | | 11/1994 | |
| JP | 08-311551 | | 11/1996 | |
| JP | 2000-256783 | | 9/2000 | |
| JP | 2000-297344 | | 10/2000 | |
| JP | 2001-073086 | | 3/2001 | |
| JP | 2005-350754 | | 12/2005 | |
| JP | 2012-026030 | | 2/2012 | |
| JP | 2012-519238 | | 8/2012 | |
| WO | 2013/094179 | | 6/2013 | |
| WO | 2013/133076 | | 9/2013 | |
| WO | WO -2013133076 | A1 * | 9/2013 | C21D 8/10 |

* cited by examiner

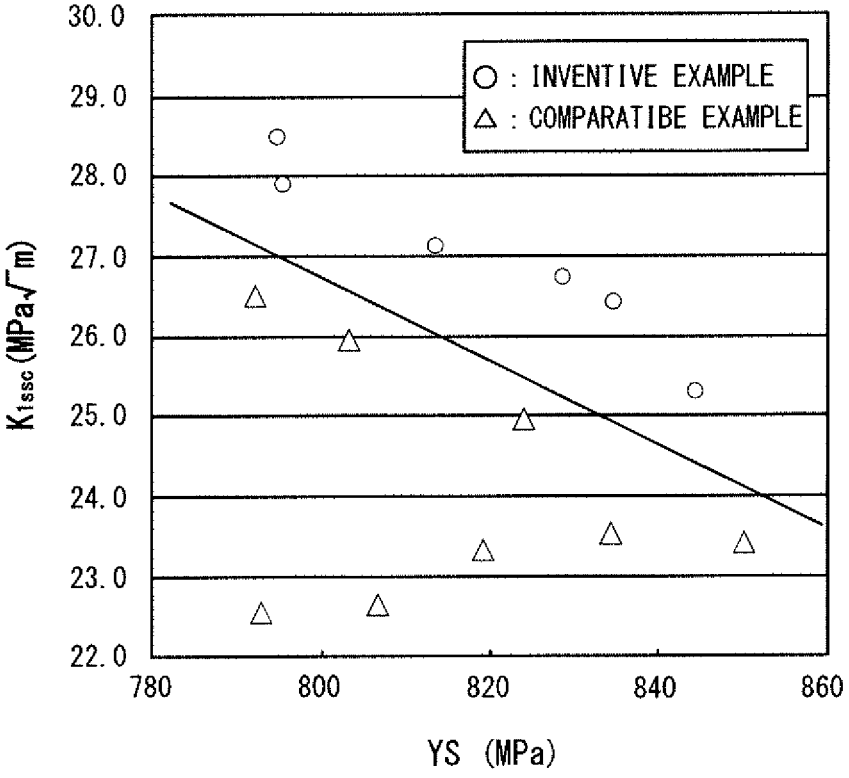
30.0
29.0
28.0
27.0
26.0
25.0
24.0
23.0
22.0
780
800
820
840
860
YS (MPa)
K1ssc (MPa√m)
○ : INVENTIVE EXAMPLE
△ : COMPARATIBE EXAMPLE

LOW ALLOY OIL-WELL STEEL PIPE

TECHNICAL FIELD

The present invention relates to a steel pipe, more specifically an oil-well steel pipe.

BACKGROUND ART

Deep-well developments of oil wells and gas wells (oil wells and gas wells are collectively referred to simply as "oil wells", hereinafter) require high strength of oil-well steel pipes. Conventionally, 80 ksi-grade (yield stress of 80 to 95 ksi, that is, 551 to 654 MPa) and 95 ksi-grade (yield stress of 95 to 110 ksi, that is, 654 to 758 MPa) oil-well steel pipes have been widely used. However, 110 ksi-grade (yield stress of 110 to 125 ksi, that is, 758 to 862 MPa) oil-well steel pipes have recently come into use.

Most deep-wells contain hydrogen sulfide having corrosiveness. Hence, oil-well steel pipes for use in deep wells are required to have not only a high strength but also a sulfide stress cracking resistance (referred to as a SSC resistance, hereinafter). In general, susceptibility to the SSC is increased along with increase in strength of a steel material.

Steel pipes of 95 ksi grade or 110 ksi grade or less, which are sold as sour-resistant oil-well steel pipes (sour service OCTG), are usually guaranteed to have a SSC resistance to endure under the $H_2S$ environment at 1 atm in an evaluation by a test method specified by NACE. Hereafter, the $H_2S$ environment at 1 atm is referred to as a standard condition.

Meanwhile, oil-well steel pipes of 125 ksi grade (yield stress of 862 to 965 MPa) have conventionally been guaranteed only to have a SSC resistance to endure under an environment in which partial pressure of $H_2S$ is much smaller than that under the standard condition, in many cases. This means that, once the lower limit of the yield strength becomes more than 110 ksi (758 MPa), it becomes suddenly difficult to secure an excellent SSC resistance.

On this background, there is a need for sour-resistant oil-well steel pipes that can secures a SSC resistance under the $H_2S$ environment at 1 atm, and have a lower limit of the yield strength as great as possible even if the lower limit of the yield strength does not reach 125 ksi (862 MPa).

Techniques to enhance the SSC resistance of oil-well steel pipes are disclosed in Japanese Patent Application Publication No. 62-253720 (Patent Literature 1), Japanese Patent Application Publication No. 59-232220 (Patent Literature 2), Japanese Patent Application Publication No. 6-322478 (Patent Literature 3), Japanese Patent Application Publication No. 8-311551 (Patent Literature 4), Japanese Patent Application Publication No. 2000-256783 (Patent Literature 5), Japanese Patent Application Publication No. 2000-297344 (Patent Literature 6), Japanese Patent Application Publication No. 2005-350754 (Patent Literature 7), National Publication of International Patent Application No. 2012-519238 (Patent Literature 8), and Japanese Patent Application Publication No. 2012-26030 (Patent Literature 9).

Patent Literature 1 proposes a method of enhancing the SSC resistance of an oil-well steel pipe by reducing impurities such as Mn and P. Patent Literature 2 proposes a method of enhancing the SSC resistance of steel by performing quenching twice to refine grains.

Patent Literature 3 proposes a method of enhancing the SSC resistance of a 125 ksi-grade steel material by refining steel microstructure through an induction heat treatment. Patent Literature 4 proposes a method of enhancing the SSC resistance of a steel pipe of 110 ksi grade to 140 ksi grade by enhancing hardenability of the steel through direct quenching process, and increasing a tempering temperature.

Each of Patent Literature 5 and Patent Literature 6 proposes a method of enhancing the SSC resistance of a low alloy oil-well steel pipe of 110 ksi grade to 140 ksi grade by controlling the morphology of carbide. Patent Literature 7 proposes a method of enhancing the SSC resistance of an oil-well steel pipe of 125 ksi (862 MPa) grade or more by controlling a dislocation density and a hydrogen diffusion coefficient to be desired values. Patent Literature 8 proposes a method of enhancing the SSC resistance of 125 ksi (862 MPa)-grade steel by quenching low alloy steel containing C of 0.3 to 0.5% several times. Patent Literature 9 proposes a method of employing a tempering step of two-stage heat treatment to control the morphology of carbide and the number of carbide particles. More specifically, in Patent Literature 9, the SSC resistance of 125 ksi (862 MPa)-grade steel is enhanced by suppressing the number density of large $M_3C$ particles or $M_2C$ particles.

CITATION LIST

Patent Literature

Patent Literature 1: Japanese Patent Application Publication No. 62-253720

Patent Literature 2: Japanese Patent Application Publication No. 59-232220

Patent Literature 3: Japanese Patent Application Publication No. 6-322478

Patent Literature 4: Japanese Patent Application Publication No. 8-311551

Patent Literature 5: Japanese Patent Application Publication No. 2000-256783

Patent Literature 6: Japanese Patent Application Publication No. 2000-297344

Patent Literature 7: Japanese Patent Application Publication No. 2005-350754

Patent Literature 8: National Publication of International Patent Application No. 2012-519238

Patent Literature 9: Japanese Patent Application Publication No. 2012-26030

Non Patent Literature

Non Patent Literature 1: TSUCHIYAMA Toshihiro, "Physical Meaning of Tempering Parameter and Its Application to Continuous Heating or Cooling Heat Treatment Process", Journal of The Japan Society for Heat Treatment, vol. 42, No. 3, P. 165 (2002).

However, even if applying the techniques disclosed in the above Patent Literatures 1 to 9, in the case of oil-well steel pipes having a yield strength of 115 ksi (793 MPa) or more, an excellent SSC resistance cannot be stably obtained in some cases.

SUMMARY OF INVENTION

An object of the present invention is to provide a low alloy oil-well steel pipe having a yield strength of 115 ksi grade or more (793 MPa or more) and an excellent SSC resistance.

A low alloy oil-well steel pipe according to the present invention includes a chemical composition consisting of: in mass %, C: 0.25 to 0.35%; Si: 0.05 to 0.50%; Mn: 0.10 to 1.50%; Cr: 0.40 to 1.50%; Mo: 0.40 to 2.00%; V: 0.05 to 0.25%; Nb: 0.010 to 0.040%; Ti: 0.002 to 0.050%; sol. Al:

0.005 to 0.10%; N: 0.007% or less; B: 0.0001 to 0.0035%; and Ca: 0 to 0.005%; and a balance being Fe and impurities, the impurities including: P: 0.020% or less; S: 0.010% or less; O: 0.006% or less; Ni: 0.10% or less; and Cu: 0.10% or less. In a microstructure, a number of cementite particles each of which has an equivalent circle diameter of 200 nm or more is 100 particles/100 $\mu m^2$ or more. The above low alloy oil-well steel pipe has a yield strength of 793 MPa or more.

The above chemical composition may contain Ca: 0.0005 to 0.005%.

The low alloy oil-well steel pipe according to the present invention has a yield strength of 115 ksi grade or more (793 MPa or more) and an excellent SSC resistance.

BRIEF DESCRIPTION OF DRAWING

FIG. 1 is a diagram to show the relationship between yield strength YS and $K_{ISSC}$.

DESCRIPTION OF EMBODIMENT

Hereinafter, an embodiment of the present invention will be described in details.

The present inventors have studied on a SSC resistance of a low alloy oil-well steel pipe. As a result, the present inventors have found the following findings.

If a steel pipe is subjected to tempering at a low temperature, a large amount of fine cementite is precipitated. The precipitated cementite has a flat morphology. Such fine cementite initiates occurrence of SSC. Further, if the tempering temperature is low, dislocation density is not decreased. Hydrogen having intruded in the steel is not only trapped at an interface between a fine cementite having a flat morphology and a parent phase, but also trapped in dislocation. SSC is likely to be caused due to the hydrogen trapped at the interface between the fine cementite and the parent phase and in the dislocation. Hence, if a large amount of fine cementite is formed, and the dislocation density is high, the SSC resistance becomes deteriorated.

Therefore, Mo and V that are alloy elements to enhance a temper softening resistance are contained in the steel pipe, and this steel pipe is subjected to tempering at a high temperature. In this case, the dislocation density becomes decreased. Hence, the SSC resistance becomes enhanced. In addition, in the case of performing tempering at a high temperature, cementite grows into coarse cementite. Fine cementite is flat, as aforementioned, and SSC is likely to be induced in its surface. To the contrary, coarse cementite grows into a spherical form so that its specific surface area becomes reduced. Hence, compared with fine cementite, coarse cementite is unlikely to initiate occurrence of SSC. Accordingly, instead of fine cementite, coarse cementite is formed, thereby enhancing the SSC resistance.

However, cementite enhances strength of a steel pipe through precipitation strengthening. As aforementioned, if tempering is performed at a high temperature, coarse cementite is formed, but only a small amount of coarse cementite is formed. In this case, although an excellent SSC resistance can be attained, it is difficult to attain a yield strength of 793 MPa or more.

In the present invention, it is configured to increase the number of coarse cementite particles each of which has an equivalent circle diameter of 200 nm or more, thereby obtaining an oil-well steel pipe having a high strength of 793 MPa or more and an excellent SSC resistance. Coarse cementite of which particle has an equivalent circle diameter of 200 nm or more is referred to as "coarse cementite", hereinafter.

In order to attain the above described oil-well steel pipe, in the tempering, low-temperature tempering at 600 to 650° C. is carried out, and thereafter, high-temperature tempering at 670 to 720° C. is carried out. In this case, a large number of fine cementite particles are formed in the low-temperature tempering. Fine cementite particles serve as nucleuses of coarse cementite particles. By precipitating a large number of fine cementite particles in the low-temperature tempering, a large number of fine cementite particles grow in the high-temperature tempering, and consequently, a large number of coarse cementite particles are formed. Hence, the number density of coarse cementite becomes enhanced. Accordingly, it is possible to attain an oil-well steel pipe having a high strength of 793 MPa or more as well as an excellent SSC resistance.

A low alloy oil-well steel pipe according to the present invention that has been accomplished based on the above findings includes a chemical composition consisting of: in mass %, C: 0.25 to 0.35%; Si: 0.05 to 0.50%; Mn: 0.10 to 1.50%; Cr: 0.40 to 1.50%; Mo: 0.40 to 2.00%; V: 0.05 to 0.25%; Nb: 0.010 to 0.040%; Ti: 0.002 to 0.050%; sol. Al: 0.005 to 0.10%; N: 0.007% or less; B: 0.0001 to 0.0035%; and Ca: 0 to 0.005%; and a balance being Fe and impurities, the impurities including: P: 0.020% or less; S: 0.010% or less; O: 0.006% or less; Ni: 0.10% or less; and Cu: 0.10% or less. In a microstructure, a number of cementite particles each of which has an equivalent circle diameter of 200 nm or more is 100 particles/100 $\mu m^2$ or more. The above low alloy oil-well steel pipe has a yield strength of 793 MPa or more.

The low alloy oil-well steel pipe according to the present invention will be described in details, hereinafter.

[Chemical Composition]

The chemical composition of the low alloy oil-well steel pipe according to the present invention contains the following elements.

C: 0.25 to 0.35%

The C content in the low alloy oil-well steel pipe according to the present invention is somewhat higher. C refines a sub-microstructure of martensite, and enhances strength of the steel. C also forms carbide to enhance strength of the steel. For example, the carbide may be cementite and alloy carbide (Mo carbide, V carbide, Nb carbide, Ti carbide, and the like). If the C content is high, spheroidization of the carbide is encouraged further, and a large number of coarse cementite particles are likely to be formed through the heat treatment to be described below, thereby enabling to attain both strength and SSC resistance. If the C content is less than 0.25%, those effects will be insufficient. On the other hand, if the C content becomes more than 0.35%, the susceptibility to quench cracking increases, so that the risk of occurrence of quench cracking increases in normal quenching treatment. Accordingly, the C content is 0.25 to 0.35%. A preferable lower limit of the C content is 0.26%. A preferable upper limit of the C content is 0.32%, and more preferably 0.30%.

Si: 0.05% to 0.50%

Silicon (Si) deoxidizes the steel. An excessively low Si content cannot attain this effect. On the other hand, an excessively high Si content rather deteriorates the SSC resistance. Accordingly, the Si content is 0.05% to 0.50%. A preferable lower limit of the Si content is 0.10%, and more preferably 0.17%. A preferable upper limit of the Si content is 0.40%, and more preferably 0.35%.

Mn: 0.10 to 1.50%

Manganese (Mn) deoxidizes the steel. An excessively low Mn content cannot attain this effect. On the other hand, an excessively high Mn content causes segregation at grain boundaries along with impurity elements such as phosphorus (P) and sulfur (S). In this case, the SSC resistance of the steel becomes deteriorated. Accordingly, the Mn content is 0.10 to 1.50%. A preferable lower limit of the Mn content is 0.20%, and more preferably 0.25%. A preferable upper limit of the Mn content is 1.00%, and more preferably 0.75%.

Cr: 0.40 to 1.50%

Chromium (Cr) enhances hardenability of the steel, and enhances strength of the steel. An excessively low Cr content cannot attain the above effect. On the other hand, an excessively high Cr content rather deteriorates toughness and the SSC resistance of the steel. Accordingly, the Cr content is 0.40 to 1.50%. A preferable lower limit of the Cr content is 0.43%, and more preferably 0.48%. A preferable upper limit of the Cr content is 1.20%, and more preferably 1.10%.

Mo: 0.40 to 2.00%

Molybdenum (Mo) forms carbide, and enhances the temper softening resistance of the steel. As a result, Mo contributes to enhancement of the SSC resistance by the high-temperature tempering. An excessively low Mo content cannot attain this effect. On the other hand, an excessively high Mo content rather saturates the above effect. Accordingly, the Mo content is 0.40 to 2.00%. A preferable lower limit of the Mo content is 0.50%, and more preferably 0.65%. A preferable upper limit of the Mo content is 1.50%, and more preferably 0.90%.

V: 0.05 to 0.25%

Vanadium (V) forms carbide, and enhances the temper softening resistance of the steel, as similar to Mo. As a result, V contributes to enhancement of the SSC resistance by the high-temperature tempering. An excessively low V content cannot attain the above effect. On the other hand, an excessively high V content rather deteriorates toughness of the steel. Accordingly, the V content is 0.05 to 0.25%. A preferable lower limit of the V content is 0.07%. A preferable upper limit of the V content is 0.15%, and more preferably 0.12%.

Nb: 0.010 to 0.040%

Niobium (Nb) forms carbide, nitride, or carbonitride in combination with C or N. These precipitates (carbide, nitride, and carbonitride) refine a sub-microstructure of the steel by the pinning effect, and enhances the SSC resistance of the steel. An excessively low Nb content cannot attain this effect. On the other hand, an excessively high Nb content forms excessive precipitates, and destabilizes the SSC resistance of the steel. Accordingly, the Nb content is 0.010 to 0.040%. A preferable lower limit of the Nb content is 0.012%, and more preferably 0.015%. A preferable upper limit of the Nb content is 0.035%, and more preferably 0.030%.

Ti: 0.002 to 0.050%

Titanium (Ti) is an effective element to prevent cast cracking. Ti forms nitride, thereby contributing to prevent the coarsening of crystal grains. For that reason, at least 0.002% of Ti is contained in the present embodiment. On the other hand, if the Ti content becomes more than 0.050%, it forms large-size nitride, destabilizing the SSC resistance of the steel. Accordingly, the Ti content is 0.002 to 0.050%. A preferable lower limit of the Ti content is 0.004%, and a preferable upper limit of the Ti content is 0.035%, more preferably 0.020%, and further preferably 0.015%.

sol. Al: 0.005 to 0.10%

Aluminum (Al) deoxidizes the steel. An excessively low Al content cannot attain this effect, and deteriorates the SSC resistance of the steel. On the other hand, an excessively high Al content results in increase of inclusions, which deteriorates the SSC resistance of the steel. Accordingly, the Al content is 0.005 to 0.10%. A preferable lower limit of the Al content is 0.01%, and more preferably 0.02%. A preferable upper limit of the Al content is 0.07%, and more preferably 0.06%. The "Al" content referred to in the present specification denotes the content of "acid-soluble Al", that is, "sol. Al".

N: 0.007% or Less

Nitrogen (N) is inevitably contained. N combines with Ti to form fine TIN, thereby refining crystal grains. On the other hand, if the N content is excessively high, coarse nitride is formed, thereby deteriorating the SSC resistance of the steel. Accordingly, the N content is 0.007% or less. A preferable N content is 0.005% or less, and more preferably 0.0045% or less. In the viewpoint of forming fine TiN, thereby refining crystal grains, a preferable lower limit of the N content is 0.002%.

B: 0.0001 to 0.0035%

Boron (B) enhances the hardenability of the steel. When B is contained 0.0001% (1 ppm) or more, the aforementioned effect is attained. On the other hand, B tends to form $M_{23}(CB)_6$ at grain boundaries, and if the B content becomes more than 0.0035%, the SSC resistance of the steel deteriorates. Accordingly, the B content is 0.0001 to 0.0035%. A preferable lower limit of the B content is 0.0003% (3 ppm), and more preferably 0.0005% (5 ppm). The B content is preferably 0.0030% or less, and more preferably 0.0025% or less. Note that to utilize the effects of B, it is preferable to suppress the N content or to immobilize N with Ti such that B which does not combine with N can exist.

Ca: 0 to 0.005%

Calcium (Ca) is an optional element, and may not be contained. If contained, Ca forms sulfide in combination with S in the steel, and improves morphology of inclusions. In this case, toughness of the steel becomes enhanced. However, an excessively high Ca content increases inclusions, which deteriorates the SSC resistance of the steel. Accordingly, the Ca content is 0 to 0.005%. A preferable lower limit of the Ca content is 0.0005%, and more preferably 0.001%. A preferable upper limit of the Ca content is 0.003%, and more preferably 0.002%.

The balance of the chemical composition of the low alloy oil-well steel pipe according to the present invention includes Fe and impurities. Impurities referred to herein denote elements which come from ores and scraps for use as row materials of the steel, or environments of manufacturing processes, and others. In the present invention, each content of P, S, O, Ni, and Cu in the impurities is specified as follows.

P: 0.020% or Less

Phosphorus (P) is an impurity. P segregates at grain boundaries, and deteriorates the SSC resistance of the steel. Accordingly, the P content is 0.020% or less. A preferable P content is 0.015% or less, and more preferably 0.010% or less. The content of P is preferably as low as possible.

S: 0.010% or Less

Sulfur (S) is an impurity. S segregates at grain boundaries, and deteriorates the SSC resistance of the steel. Accordingly, the S content is 0.010% or less. A preferable S content is 0.005% or less, and more preferably 0.002% or less. The content of S is preferably as low as possible.

O: 0.006% or Less

Oxygen (O) is an impurity. O forms coarse oxide, and deteriorates a corrosion resistance of the steel. Accordingly, the O content is 0.006% or less. A preferable O content is 0.004% or less, and more preferably 0.0015% or less. The content of O is preferably as low as possible.

Ni: 0.10% or Less

Nickel (Ni) is an impurity. Ni deteriorates the SSC resistance of the steel. If the Ni content is more than 0.10%, the SSC resistance becomes significantly deteriorated. Accordingly, the content of Ni as an impurity element is 0.10% or less. The Ni content is preferably 0.05% or less, and more preferably 0.03% or less.

Cu: 0.10% or Less

Copper (Cu) is an impurity. Copper embrittles the steel, and deteriorates the SSC resistance of the steel. Accordingly, the Cu content is 0.10% or less. The Cu content is preferably 0.05% or less, and more preferably 0.03% or less.

[Microstructure]

The microstructure of the low alloy oil-well steel pipe having the aforementioned chemical composition is formed of tempered martensite and retained austenite of 0 to less than 2% in terms of a volume fraction.

The microstructure of the low alloy oil-well steel pipe according to the present invention is substantially a tempered martensite microstructure. Hence, the yield strength of the low alloy oil-well steel pipe is high. Specifically, the yield strength of the low alloy oil-well steel pipe of the present invention is 793 MPa or more (115 ksi grade or more). The yield strength referred to in the present specification is defined by the 0.7% total elongation method.

In the aforementioned low alloy oil-well steel pipe, retained austenite still remains after the quenching in some cases. The retained austenite causes variation in strength. Accordingly, the volume ratio (%) of the retained austenite is less than 2% in the present invention. The volume ratio of the retained austenite is preferably as small as possible. Accordingly, it is preferable that in the microstructure of the aforementioned low alloy oil-well steel pipe, the volume ratio of the retained austenite is 0% (i.e., microstructure formed of tempered martensite). If the cooling stop temperature in the quenching process is sufficiently low, preferably 50° C. or less, the volume ratio (%) of the retained austenite is suppressed less than 2%.

The volume ratio of the retained austenite is found by using X-ray diffraction analysis by the following process. Samples including central portions of wall thickness of produced low alloy oil-well steel pipes are collected. A surface of each collected sample is subjected to chemical polishing. The X-ray diffraction analysis is carried out on each chemically polished surface by using a CoKα ray as an incident X ray. Specifically, using each sample, respective surface integrated intensities of a (200) plane and a (211) plane in a ferrite phase (a phase), and respective surface integrated intensities of a (200) plane, a (220) plane, and a (311) plane in the retained austenite phase (γ phase) are respectively found. Subsequently, the volume ratio Vγ(%) is calculated by using Formula (1) for each combination between each plane in the α phase and each plane in the γ phase (6 sets in total). An average value of the volume ratios Vγ(%) of the 6 sets is defined as the volume ratio (%) of the retained austenite.

$$V\gamma=100/(1+(I\alpha\times R\gamma)/(I\gamma\times R\alpha)) \quad (1),$$

where "Iα" and "Iγ" are respective integrated intensities of the α phase and the γ phase. "Rα" and "Rγ" are respective scale factors of the α phase and the γ phase, and these values are obtained through a crystallographic logical calculation based on the types of the substances and the plane directions.

The aforementioned microstructure can be obtained by carrying out the following producing method.

[Prior-Austenite Grain Size No.]

In the present invention, it is preferable that the grain size No. based on ASTM E112 of prior-austenite grains (also referred to as prior-γ grains, hereinafter) in the aforementioned microstructure is 9.0 or more. If the grain size No. is 9.0 or more, it is possible to attain an excellent SSC resistance even if the yield strength is 793 MPa or more. A preferable grain size No. of the prior-γ grains (also referred to as prior-γ grain size No., hereafter) is 9.5 or more.

The prior-γ grain size No. may be measured by using a steel material after being quenched and before being tempered (so-called as-quenched material), or by using a tempered steel material (referred to as a tempered material). The size of the prior-γ grains is not changed in the tempering. Accordingly, the size of the prior-γ grains stays the same using any one of a material as quenched and a tempered material. If steel including the aforementioned chemical composition is used, the prior-γ grain size No. becomes 9.0 or more through well-known quenching described later.

[Number of Coarse Cementite Particles]

In the present invention, further, in the aforementioned substructure, the number of coarse cementite particles CN each of which has an equivalent circle diameter of 200 nm or more is 100 particles/100 $\mu m^2$ or more.

Cementite enhances the yield strength of the steel pipe. Hence, if the number of cementite particles is excessively small, the yield strength of the steel pipe decreases. On the other hand, if the cementite is fine, the cementite has a needle-like morphology. In this case, the cementite is more likely to be an initiator of occurrence of the SSC, resulting in deterioration of SSC resistance.

If fine cementite is grown to be coarsened by appropriately selecting a steel composition and a heat treatment condition, the number of fine cementite becomes decreased. As a result, the SSC resistance becomes improved.

It is difficult to directly measure the number of fine cementite particles. For this reason, this is substituted by measurement of the number of coarse cementite particles. The total amount of cementite is determined by the carbon content in the steel. Consequently, if the number of coarse cementite particles is greater, the number of fine cementite particles becomes smaller. If the number of coarse cementite particles CN is 100 particles/100 $\mu m^2$, it is possible to attain an excellent SSC resistance even if the steel pipe has a yield strength of 793 MPa or more. The number of coarse cementite particles CN is measured by the following method.

Samples including central portions of wall thickness of steel pipes are collected. Of a surface of each sample, a surface equivalent to a cross sectional surface (sectional surface vertical to an axial direction of the steel pipe) of each steel pipe (referred to as an observation surface, hereinafter) is polished. Each observation surface after being polished is etched using a nital etching reagent.

Using a scanning electron microscope, any 10 visual fields in each etched observation surface are observed. Each visual field has an area of 10 μm×10 μm. In each visual field, each area of plural cementite particles is found. The area of each cementite particle may be found using image processing software (brand name: Image J1.47v), for example. A diameter of a circle having the same area as that of the obtained area is defined as an equivalent circle diameter of the cementite particle of interest.

In each visual field, cementite particles each of which has an equivalent circle diameter of 200 nm or more (i.e., coarse cementite particles) are identified. A total number of coarse cementite particles TN in all the 10 visual fields are found. Using the total number TN, the number of coarse cementite particles CN is found based on Formula (2).

$$CN=TN/\text{Total area of 10 visual fields}\times 100 \quad (2)$$

With the above chemical composition, and a number of coarse cementite particles CN of 100 particles/100 $\mu m^2$ or more, a low alloy oil-well steel pipe has a yield strength of 793 MPa and more, and an excellent SSC resistance.

A preferable lower limit of the number of coarse cementite particles CN is 120 particles/100 $\mu m^2$. Although the upper limit of the number of coarse cementite particles CN is not particularly limited, in the case of the aforementioned chemical composition, a preferable upper limit of the number of coarse cementite particles CN is 250 particles/100 $\mu m^2$.

[Producing Method]

An example of a producing method of the low alloy oil-well steel pipe according to the present invention will be explained. In this example, the producing method of a seamless steel pipe (low alloy oil-well steel pipe) will be described. The producing method of the seamless steel pipe includes a pipe making process, a quenching process, and a tempering process.

[Pipe Making Process]

Steel including the aforementioned chemical composition is melted, and smelted by using a well-known method. Subsequently, the molten steel is formed into a continuous casted material through a continuous casting process, for example. The continuous casted material is slabs, blooms, or billets, for example. Alternatively, the molten steel may be formed into ingots through an ingot-making process.

Slabs, blooms, or ingots are subjected to hot working into billets. The billets may be formed by hot-rolling or hot-forging the steel.

The billets are hot-worked into hollow shells. First, the billets are heated in a heating furnace. The billets extracted from the beating furnace are subjected to hot working into hollow shells (seamless steel pipes). For example, the Mannesmann process is carried out as the hot working so as to produce the hollow shells. In this case, round billets are piercing-rolled by a piercing mill The piercing-rolled round billets are further hot-rolled by a mandrel mill, a reducer, a sizing mill, or the like into the hollow shells. The hollow shells may be produced from billets with other hot working methods.

[Quenching Process]

The hollow shells after the hot working are subjected to quenching and tempering. A quenching temperature in the quenching is the $Ac_3$ point or more. A preferable upper limit of the quenching temperature is 930° C.

In the present invention, the prior-y grain size No. of a steel pipe is 9.0 or more. In order to realize this grain size, it is preferable that at least one transformation from a BCC (Body-Centered Cubic) phase to an FCC (Face-Centered Cubic) phase is performed, and it is preferable to perform off-line quenching. It is difficult to realize fine grains of a prior-γ grain size No. of 9.0 or more by direct quenching or in-line quenching (quenching after soaking at. $Ar_3$ point or more without significant temperature drop after hot pipe-making).

To attain fine grains of a prior-γ grain size No. of 9.0 or more, it is preferable to perform normalizing (normalizing as an intermediate heat treatment) by heating the steel pipe to $Ac_3$ point or more before performing off-line quenching. Moreover, in place of normalizing, off-line quenching (quenching as an intermediate heat treatment) may be carried out.

Moreover, in place of the aforementioned normalizing and quenching as intermediate heat treatments, heat treatment at a temperature in a two phase range from more than the $Ac_3$ point to less than the $Ac_3$ point (a two phase range heat treatment as an intermediate heat treatment) may be carried out. Also in this case, there is remarkable effect in refining the prior-γ grains.

It is possible to refine the prior-γ grains of the hollow shells which has been quenched once by a direct quenching or an inline quenching by further performing off-line quenching. In such a case, by subjecting the hollow shell, which has been subjected to a direct quenching or an inline quenching, to a heat treatment at a temperature of 500° C. to 580° C. for about 10 to 30 minutes, it is possible to suppress season cracking and impact cracking which may occur during storage before off-line quenching or during transportation.

The quenching is carried out by a rapid cooling from a temperature of the $Ac_3$ point or more to the martensite transformation-start temperature. The rapid cooling includes, for example, water cooling, mist spray quenching, etc.

The prior-γ grain size No. of the hollow shell after the aforementioned quenching step becomes 9.0 or more. Note that, the grains size of prior-γ grains is not changed even after the tempering to be described later.

[Tempering Process]

The tempering step includes a low-temperature tempering process and a high-temperature tempering process.

[Low-Temperature Tempering Process]

First, the low-temperature tempering process is carried out. The tempering temperature TL in the low-temperature tempering process is 600 to 650° C. A Larson-Miller parameter $LMP_L$. in the low-temperature tempering process is 17500 to 18750.

When the tempering temperature is constant, the Larson-Miller parameter is defined by following Formula (3).

$$LMP=(T+273)\times(20+\log(t)) \quad (3)$$

In Formula (3), T denotes a tempering temperature (° C.), and t denotes a time (hr).

When the tempering temperature is not constant, in other word, the tempering process includes a heating process in which temperature increases and a soaking process in which temperature is constant, the Larson-Miller parameter taking account of the heating process can be found by calculating it as an integrated tempering parameter in accordance with Non-Patent Literature 1 (TSUCHIYAMA, Toshihiro. 2002. "Physical Meaning of Tempering Parameter and Its Application for Continuous Heating or Cooling Heat Treatment Process", "Heat Treatment" Vol. 42, No. 3, pp: 163-166 (2002)).

In the method of calculating the abovementioned integrated tempering parameter, a time from start of the heating until end of the heating is divided by micro times Δt of total number N. Herein, an average temperature in the (n−1)-th section is defined as $T_{n-1}$(° C.) and an average temperature in the n-th section is defined as $T_n$(° C.). An LMP (1) corresponding to the first micro time (the section when n=1) can be obtained by the following formula.

$$LMP(1)=(T_1+273)+(20+\log(\Delta t))$$

The LMP (1) can be described as a value equivalent to an LMP calculated based on a temperature $T_2$ and a heating time $t_2$ by the following formula.

$$(T_1+273)\times(20+\log(\Delta t))=(T_2+273)\times(20+\log(t_2))$$

The time $t_2$ is a time required (an equivalent time) to obtain an LMP at temperature $T_2$ equivalent to an integrated value of LMP calculated based on a heating at a section before the second section (that is, the first section). The heating time at the second section (temperature $T_2$) is a time obtained by adding an actual heating time $\Delta t$ to the time $t_2$. Accordingly, an LMP (2) which is an integrated value of LMP when the heating of the second section is completed can be obtained by the following formula.

$$\mathrm{LMP}(2)=(T_2+273)+(20+\log(t_2+\Delta t))$$

By generalizing this formula, the following formula can be obtained.

$$\mathrm{LMP}(n)=(T_n+273)\times(20+\log(t_n+\Delta t)) \quad (4)$$

The LMP(n) is the integrated value of LMP when the heating of n-th section is completed. The time $t_n$ is an equivalent time to obtain an LMP equivalent to an integrated value of LMP when the heating of the (n−1)-th section is completed, at temperature $T_n$. The time $t_n$ can be obtained by Formula (5).

$$\log(t_n)=((T_{n-1}+273)/(T_n+273))\times(20+\log(t_{n-1}))-20 \quad (5)$$

As so far described, when heating process needs to be taken into account, Formula (4) in place of Formula (3) is applied.

In the low-temperature tempering process, as described above, a large amount of C (carbon) supersaturatedly dissolved in the martensite is precipitated as cementite. The precipitated cementite at this stage is fine cementite, and serves as a nucleus of coarse cementite. An excessively low temperature of the low-temperature tempering $T_L$ or an excessively low $LMP_L$ results in a small amount of precipitated cementite. On the other hand, an excessively high temperature of the low-temperature tempering $T_L$ or an excessively high $LMP_L$ causes growth of coarse cementite, but results in a small amount of precipitated cementite.

If the temperature of the low-temperature tempering $T_L$ is 600 to 650° C., and the $LMP_L$ is 17500 to 18750, a large amount of fine cementite serving as a nucleus of coarse cementite is precipitated in the low-temperature tempering process.

[High-Temperature Tempering Process]

The high-temperature tempering process is carried out after the low-temperature tempering process. In the high-temperature tempering process, the fine cementite precipitated in the low-temperature tempering process is coarsened, thereby forming coarse cementite. Accordingly, it is possible to prevent the cementite from becoming an initiator of SSC, as well as to enhance strength of the steel with the coarse cementite.

In the high-temperature tempering process, dislocation density in the steel is reduced. Hydrogen having intruded in the steel is trapped in the dislocation, and becomes an initiator of SSC. Hence, if the dislocation density is higher, the SSC resistance becomes enhanced. The dislocation density in the steel becomes reduced by carrying out the high-temperature tempering process. Accordingly, the SSC resistance becomes improved.

For the purpose of attaining the above effect, the tempering temperature $T_H$ in the high-temperature tempering process is 670 to 720° C., and the Larson-Miller parameter $LMP_H$ defined by Formula (3) and Formula (4) is $1.85\times10^4$ to $2.05\times10^4$.

If the tempering temperature $T_H$ is excessively low, or the $LMP_H$ is excessively low, the cementite is not coarsened, and the number of the coarse cementite particles CN becomes less than 100 particles/100 $\mu m^2$. Furthermore, the dislocation density is not sufficiently reduced. Consequently, the SSC resistance is low.

On the other hand, if the tempering temperature $T_H$ is excessively high, or the $LMP_H$ is excessively high, the dislocation density is excessively reduced. In this case, the yield strength of the steel pipe including the aforementioned chemical composition becomes less than 793 MPa.

In the tempering process of the present invention, the two-stage tempering including the low-temperature tempering process and the high-temperature tempering process may be carried out, as aforementioned. Specifically, the steel pipe is cooled down to a normal temperature after the low-temperature tempering process is carried out. Subsequently, the high-temperature tempering process is carried out by heating the steel pipe having the normal temperature. Alternatively, immediately after the low-temperature tempering process is carried out, the high-temperature tempering process may be carried out by heating the steel pipe up to the temperature of the high-temperature tempering $T_H$ without cooling the steel pipe.

Alternatively, the low-temperature tempering process and the high-temperature tempering process may be continuously carried out in such a manner that the temperature of the steel pipe is brought to a high-temperature range at a low heating rate so as to increase the retaining time in a temperature range of 600 to 650° C. (tempering with slow temperature increase). For example, at the time of tempering the steel pipe after being quenched, the steel pipe is continuously heated up to 710° C. at an average heating rate of 3° C./minute or less in a temperature range of 500° C. to 700° C., and the steel pipe is soaked at 710° C. for a predetermined time (e.g., for 60 minutes). In this case, it is only required that an integrated value of the Larson-Miller parameter $LMP_L$ in the temperature range of the low-temperature tempering $T_L$ (i.e., 600 to 650° C. range) is $1.75\times10^4$ to $1.88\times10^4$, and an integrated value of the Larson-Miller parameter $LMP_H$ in the temperature range of the high-temperature tempering $T_H$ (i.e., 670 to 720° C. range) is $1.85\times10^4$ to $2.05\times10^4$. In other words, in the tempering process, as far as the $LMP_L$ in the temperature range of the low-temperature tempering $T_L$ satisfies the above condition, and the $LMP_H$ in the temperature range of the high-temperature tempering $T_H$ satisfies the above condition, the tempering method is not limited to specific one.

Through the above producing method, the low alloy seamless steel pipe according to the present invention is produced. The microstructure of the produced seamless steel pipe is formed of the tempered martensite and the retained austenite of 0 to less than 2%. In addition, the prior-γ grain size No. is 9.0 or more. Through the above described tempering process, the number of coarse cementite particles CN in the microstructure becomes 100 particles/100 $\mu m^2$ or more.

Example

There were produced molten steels having each chemical composition as shown in Table 1A and Table 1B.

TABLE 1A

| Steel | Chemical Composition (Unit: mass %, Balance: Fe and Impurites) | | | | | | | | | |
|---|---|---|---|---|---|---|---|---|---|---|
| | C | Si | Mn | Cr | Mo | V | Nb | Ti | sol.Al | N |
| A | 0.26 | 0.30 | 0.44 | 0.49 | 0.70 | 0.090 | 0.012 | 0.010 | 0.047 | 0.0030 |
| B | 0.26 | 0.30 | 0.44 | 1.00 | 0.70 | 0.090 | 0.030 | 0.011 | 0.040 | 0.0045 |
| C | 0.20 | 0.20 | 0.60 | 0.59 | 0.69 | 0.060 | 0.012 | 0.008 | 0.035 | 0.0036 |
| D | 0.45 | 0.31 | 0.47 | 1.04 | 0.70 | 0.100 | 0.013 | 0.009 | 0.030 | 0.0026 |

TABLE 1B (Continued from TABLE 1A)

| Steel | Chemical Composition (Unit: mass %, Balance: Fe and Impurities) | | | | | | |
|---|---|---|---|---|---|---|---|
| | B | Ca | P | S | O | Ni | Cu |
| A | 0.0013 | 0.0018 | 0.007 | 0.0010 | 0.0012 | 0.03 | 0.03 |
| B | 0.0012 | — | 0.007 | 0.0010 | 0.0011 | 0.02 | 0.02 |
| C | 0.0012 | 0.0020 | 0.005 | 0.0015 | 0.0010 | 0.01 | 0.01 |
| D | — | 0.0018 | 0.012 | 0.0014 | 0.0007 | 0.03 | 0.01 |

With reference to Table 1A and Table 1B, the chemical compositions of Steel A and Steel B were within the range of the present invention. The C (carbon) content of Steel C was excessively low. Steel D contained excessively high C (carbon) and no B.

The above molten steels were used to produce slabs by continuous casting. The slabs were bloomed into round billets each having a diameter of 310 mm. The round billets were piercing-rolled and drawing-rolled into seamless steel pipes each having a diameter of 244.48 mm and a wall thickness of 13.84 mm through the Mannesmann-mandrel process.

Regarding the case where steels A and B were used, quenching (inline quenching) was carried out after soaking at 920° C. without lowering the temperature of the steel pipe to the $Ar_3$ point or less after completion of hot rolling. In the case where steels C and D were used, the steel pipe was subjected to allowing cooling after hot pipe making.

Each seamless steel pipe was subjected to quenching in which each steel pipe was reheated to 900° C. and soaked for 15 minutes, thereafter being water cooled. However, as shown in Table 2, Test Nos. 4 to 6, and Test Nos. 11 to 13 were subjected to quenching in which each steel pipe was reheated to 920° C. and soaked for 15 minutes, thereafter being water cooled. Moreover, Test No. 15 used steel D. Although, Test No. 15 was planned to be subjected to quenching twice, since quench cracking occurred in the first quenching operation, the following process was cancelled, excluding it from evaluation.

Each of the seamless steel pipes after being quenched was subjected to the tempering as shown in Table 2.

TABLE 2

| Test No. | Steel | Intermediate heat treatment | Low-Tmeperature Tempering $T_L$ (° C.) | $t_L$ (min) | $LMP_L$ | High-Temperature Tempering $T_H$ (° C.) | $t_H$ (min) | $LMP_H$ | Note |
|---|---|---|---|---|---|---|---|---|---|
| 1 | A | — | Low Heating Rate | | 17743 | 700 | 60 | 19518 | Inventive Example |
| 2 | A | — | Low Heating Rate | | 17583 | 680 | 155 | 19462 | Inventive Example |
| 3 | A | — | 600 | 120 | 17732 | 700 | 60 | 19483 | Inventive Example |
| 4 | B | Water | Low Heating Rate | | 17743 | 700 | 60 | 19518 | Inventive Example |
| 5 | B | cooling after | Low Heating Rate | | 17583 | 680 | 155 | 19462 | Inventive Example |
| 6 | B | soaking at 920° C. for 15 minutes | 600 | 120 | 17732 | 700 | 60 | 19483 | Inventive Example |
| 7 | A | — | 710 | 45 | 19567 | — | — | — | Comparative Example |
| 8 | A | — | 710 | 60 | 19683 | — | — | — | Comparative Example |
| 9 | A | — | 700 | 30 | 19210 | — | — | — | Comparative Example |
| 10 | A | — | 705 | 45 | 19468 | — | — | — | Comparative Example |
| 11 | B | Water | 700 | 60 | 19482 | — | — | — | Comparative Example |
| 12 | B | cooling after | 710 | 45 | 19567 | — | — | — | Comparative Example |
| 13 | B | soaking at 920° C. for 15 minutes | 695 | 60 | 19382 | — | — | — | Comparative Example |
| 14 | C | — | 600 | 120 | 17732 | 700 | 60 | 19483 | Comparative Example |
| 15 | D | Water | — | — | — | — | — | — | Comparative Example |
| 16 | B | cooling after soaking at 920° C. for 15 minutes | 600 | 120 | 17732 | 720 | 300 | 20560 | Comparative Example |

With reference to Table 2, in Test Nos. 3, 6, 14, and Test No. 16, two-stage tempering was carried out. Specifically, in each Test No., first, the low-temperature tempering was carried out under tempering conditions ($T_L$, $t_L$, $LMP_L$) as shown in Table 2. Reference Numeral $t_L$. in Table 2 denotes a soaking time (minutes) at the tempering temperature $T_L$. After the low-temperature tempering was carried out, each seamless steel pipe was subjected to allowing cooling to be cooled down to a room temperature (25° C.). Using the seamless steel pipe after the allowing cooling, the high-temperature tempering was carried out under tempering conditions ($T_H$, $t_H$, $LMP_H$) as shown in Table 2. Reference Numeral hi in Table 2 denotes a soaking time (minutes) at the tempering temperature $T_H$. In each Test No., the heating rate in the heating process was 8° C./minute, and the temperature of each seamless steel pipe was continuously increased. Taking account of each heating process, the $LMP_L$ and the $LMP_H$ were calculated by using Formulae (3) and (4), as in the above manner. In calculating an integrated value of the $LMP_L$ and the $LMP_H$, Δt was set to be 1/60 hour (1 minute). As for Test Nos. 3, 6, 7 to 14 and 16, $T_1$ (average temperature of the first section) was set to a temperature 100° C. lower than the tempering temperature of each Test No. The results are shown in Table 2.

On the other hand, tempering was carried out after: each steel pipe was continuously heated at a heating rate of 2° C./min until the temperature reaches 700° C. in Test Nos. 1 and 4; each steel pipe was continuously heated at a heating rate of 3° C./min until the tempering temperature reaches 680° C. in Test Nos. 2 and 5; and each steel pipe was soaked at 700° C. for 60 minutes in Test Nos. 1 and 4, and each steel pipe was soaked at 680° C. for 155 minutes in Test Nos. 2 and 5. That is, in Test Nos. 1, 2, 4, and 5, tempering at a low heating rate was carried out. In the tempering at a low heating rate, the $LMP_L$ (calculated by Formula (4)) in a tempering temperature range of 600 to 650° C. was as shown in Table 2. Moreover, the total $LMP_H$ of the LMP (calculated based on Formula (4)) while the tempering temperature was increased from 670° C. to the tempering temperature ($T_H$), and the LMP (calculated based on Formula (3)) when soaking was carried out at the tempering temperature ($T_H$) for $T_H$ minutes was as shown in Table 2. In Test Nos. 1, 2, 4, and 5, the equivalent time at the tempering temperature $T_H$ of the high-temperature tempering was calculated based on an integrated value of LMP in the heating process from 670° C. to the tempering temperature $T_H$. The $LMP_H$ was calculated by Formula (4) using the sum of a soaking time at the tempering temperature $T_H$ and the equivalent time.

In Test Nos. 7 to 13, only one stage tempering (high temperature tempering) was carried out. In this case, each steel pipe was continuously heated at a heating rate of 8° C./min.

[Prior-γ Grain Size No. Measurement Test]

Using the seamless steel pipe after being quenched of each Test No., the prior-y grain size No. conforming to ASTM 112E was found. Each obtained prior-γ grain size No. is shown in Table 3. Each prior-γ grain size No. was 9.0 or more.

[Microstructure Observation Test]

A sample including a central portion of wall thickness of the seamless steel pipe after being tempered in each Test No. was collected. Of each collected sample, a sample surface of a cross section vertical to the axial direction of each seamless steel pipe was polished. After being polished, each polished sample surface was etched usingnital. Each etched surface was observed with a microscope, and as a result, in each Test No., the sample had a microstructure formed of the tempered martensite. The volume ratio of the retained austenite was measured in the above described manner, and as a result, in each Test No., the volume ratio of the retained austenite was less than 2%.

[Number of Coarse Cementite Particles CN]

Using the seamless steel pipe after being tempered of each Test No., the number of coarse cementite particles CN (particles/100 $\mu m^2$) was found in the above described manner. Each obtained number of coarse cementite particles CN was shown in Table 3.

[Yield Strength Test]

A No. 12 test specimen (width: 25 mm, gage length: 50 mm) specified in JIS Z2201 was collected from a central portion of wall thickness of the seamless steel pipe of each Test No. A central axis of each test specimen was located at the central position of the wall thickness of each seamless steel pipe, and was parallel with the longitudinal direction of each seamless steel pipe. Using each collected test specimen, a tensile test conforming to JIS 22241 was carried out in the atmosphere at a normal temperature (24° C.) so as to find a yield strength (YS). The yield strength was found by the 0.7% total elongation method. Each obtained yield strength (MPa) was shown in Table 3. In examples of the present invention, every seamless steel pipe has a yield strength of 115 ksi (793 MPa) or more.

[DCB Test]

The seamless steel pipe of each Test No, was subjected to a DCB (double cantilever beam) test so as to evaluate the SSC resistance.

Specifically, three DCB test specimens each of which had a thickness of 10 mm, a width of 25 mm, and a length of 100 mm were collected from each seamless steel pipe. Using the collected DCB test specimens, the DCB test was carried out in compliance with NACE (National Association of Corrosion Engineers) TM0177-2005 Method D. A 5% salt+0.5% acetic acid aqueous solution having a normal temperature (24° C.) in which hydrogen sulfide gas at 1 atm was saturated was used for a test bath. The DCB test was carried out in such a manner that each DCB test specimen was immersed in the test bath for 336 hours. Each test specimen was put under tension by using a wedge which gives the two arms of the DCB test specimen a displacement of 0.51 mm (+0.03 mm/−0.05 mm) and exposed in a test liquid for 14 days.

After the test, a length of crack propagation "a" generated in each DCB test specimen was measured. Using the measured length of the crack propagation "a" and a wedge-release stress P, each stress intensity factor $K_{ISSC}$(ksi√in) was found based on the following Formula (6).

$$K_{ISSC}=PA((2(\sqrt{3})+2.38\times(h/a))\times(B/Bn)^{1/(\sqrt{3})})/(B\times h^{3/2}) \quad (6)$$

Where, "h" in Formula (6) denotes a height of each arm of each DCB test specimen, "B" denotes a thickness of each DCB test specimen, and "Bn" denotes a web thickness of each DCB test specimen. These are specified in the above NACE TM0177-2005 Method D.

An average value of the stress intensity factors obtained in the three DCB test specimens in each Test No. was defined as a stress intensity factor $K_{ISSC}$ of that Test No.

[Test Results]

TABLE 3

| Test No. | Steel | Prior-γ Grain Size No. | CN (grains/ 100 $\mu m^2$) | YS (MPa) | YS (ksi) | $K_{ISSC}$ Average Value (MPa√m) | $K_{ISSC}$ Average Value (ksi√inch) | Note |
|---|---|---|---|---|---|---|---|---|
| 1 | A | 9.2 | 145 | 796 | 115.4 | 27.9 | 25.4 | Inventive Example |
| 2 | A | 9.0 | 192 | 814 | 118 | 27.1 | 24.7 | Inventive Example |

TABLE 3-continued

| Test No. | Steel | Prior-γ Grain Size No. | CN (grains/ 100 μm²) | YS (MPa) | YS (ksi) | $K_{ISSC}$ Average Value (MPa√m) | $K_{ISSC}$ Average Value (ksi√inch) | Note |
|---|---|---|---|---|---|---|---|---|
| 3 | A | 9.1 | 138 | 835 | 121.1 | 26.4 | 24.0 | Inventive Example |
| 4 | B | 10.1 | 124 | 845 | 122.5 | 25.3 | 23.0 | Inventive Example |
| 5 | B | 10.0 | 179 | 795 | 115.3 | 28.5 | 25.9 | Inventive Example |
| 6 | B | 10.1 | 150 | 829 | 120.2 | 26.7 | 24.3 | Inventive Example |
| 7 | A | 8.8 | 76 | 819 | 118.8 | 23.3 | 21.2 | Comparative Example |
| 8 | A | 9.0 | 85 | 803 | 116.5 | 25.9 | 23.6 | Comparative Example |
| 9 | A | 9.0 | 46 | 834 | 121 | 23.5 | 21.4 | Comparative Example |
| 10 | A | 9.9 | 35 | 807 | 117 | 22.6 | 20.6 | Comparative Example |
| 11 | B | 10.3 | 59 | 824 | 119.5 | 24.9 | 22.7 | Comparative Example |
| 12 | B | 10.3 | 60 | 794 | 115.2 | 26.5 | 24.1 | Comparative Example |
| 13 | B | 10.3 | 50 | 850 | 123.3 | 23.4 | 21.3 | Comparative Example |
| 14 | C | 9.6 | 35 | 793 | 115 | 22.5 | 20.5 | Comparative Example |
| 15 | D | — | — | — | — | — | — | Comparative Example |
| 16 | B | 10.0 | — | 659 | 95.5 | — | — | Comparative Example |

With reference to Table 3, each of Test Nos. 3 and 6 had an appropriate chemical composition. Also, in the tempering, the two-stage tempering (the low-temperature tempering and the high-temperature tempering) was carried out, and each tempering condition was appropriate. As a result, each seamless steel pipe had a prior-γ grain size No. of 9.0 or more, and a number of coarse cementite particles CN of 100 particles/100 μm² or more. Further, each seamless steel pipe had a $K_{ISSC}$ greater than those of Comparative Examples having the same level of yield strength YS, and had an excellent SSC resistance.

Each of Test Nos. 1 and 2, and Test Nos. 4 and 5 had an appropriate chemical composition. Further, the low-heating rate tempering was carried out, and each condition thereof was appropriate. As a result, each seamless steel pipe had a prior-γ grain size No. of 9.0 or more, and a number of coarse cementite particles CN of 100 particles/100 μm² or more. Further, each seamless steel pipe had a $K_{ISSC}$ greater than those of Comparative Examples having the same level of yield strength YS, and had an excellent SSC resistance.

Meanwhile, in each of Test Nos. 7 to 13, the low-temperature tempering and the tempering corresponding to the low-heating rate tempering were not carried out. As a result, in each of these Test Nos., the number of coarse cementite particles CN was less than 100 particles/100 μm².

Test No. 14 was subjected to the two-stage tempering; since the C content was 0.20% which was less than the lower limit of the present invention, the number of coarse cementite particles CN was less than 100 particles/100 μm². Test No. 16 was also subjected to the two-stage tempering; since the $LMP_H$ of the high-temperature tempering was too high, the yield strength YS was too low.

FIG. 1 is a diagram to show the result of Table 3 as a relationship between yield strength YS and $K_{ISSC}$. In general, it is well known that in a low alloy steel, $K_{ISSC}$ tends to decrease as yield strength YS increases. However, in FIG. 1, it was made clear that the steel pipe of the present invention showed a higher $K_{ISSC}$ at a same yield strength.

As aforementioned, the embodiment of the present invention has been explained. However, the aforementioned embodiment is merely an exemplification for carrying out the present invention. Accordingly, the present invention is not limited to the aforementioned embodiment, and the aforementioned embodiment can be appropriately modified and carried out without departing from the scope of the present invention.

The invention claimed is:

1. A low alloy oil-well steel pipe characterized by comprising a chemical composition consisting of:

in mass %,

C: 0.25 to 0.35%;

Si: 0.05 to 0.50%;

Mn: 0.10 to 1.50%;

Cr: 0.40 to 1.50%;

Mo: 0.40 to 2.00%;

V: 0.05 to 0.25%;

Nb: 0.010 to 0.040%;

Ti: 0.002 to 0.050%;

sol.Al: 0.005 to 0.10%;

N: 0.007% or less;

B: 0.0001 to 0.0035%;

Ca: 0 to 0.005%; and a balance being Fe and impurities, the impurities including:

P: 0.020% or less;

S: 0.010% or less;

O: 0.006% or less;

Ni: 0.10% or less; and

Cu: 0.10% or less, wherein in a microstructure of the low alloy oil-well steel pipe, a number of cementite particles, each of which having an equivalent circle diameter of 200 nm or more, is 100 to 250 particles/100 $\mu m^2$, and a yield strength is 793 MPa or more.

2. The low alloy oil-well steel pipe according to claim 1, wherein Ca ranges from 0.0005 to 0.005%.

* * * * *